US012593889B2

(12) United States Patent
Diaz

(10) Patent No.: US 12,593,889 B2
(45) Date of Patent: Apr. 7, 2026

(54) VENTED HAT SWEATBAND

(71) Applicant: Alberto S. Diaz, St. Paul, MN (US)

(72) Inventor: Alberto S. Diaz, St. Paul, MN (US)

( * ) Notice: Subject to any disclaimer, the term of this patent is extended or adjusted under 35 U.S.C. 154(b) by 0 days.

(21) Appl. No.: 19/309,763

(22) Filed: Aug. 26, 2025

(65) Prior Publication Data

US 2025/0386893 A1 Dec. 25, 2025

Related U.S. Application Data

(63) Continuation of application No. 19/182,763, filed on Apr. 18, 2025.

(60) Provisional application No. 63/641,649, filed on May 2, 2024.

(51) Int. Cl.
*A42C 5/02* (2006.01)
*A42C 5/04* (2006.01)

(52) U.S. Cl.
CPC . *A42C 5/02* (2013.01); *A42C 5/04* (2013.01)

(58) Field of Classification Search
CPC .... A42C 5/04; A42C 5/02; A42C 5/00; A42B 1/008; A42B 1/0189; A42B 1/0182; A42B 1/019; A42B 1/0192; A42B 1/02; A42B 1/205; A42B 3/124; A42B 3/28; A42B 3/281
USPC ..... 2/182.5, 182.7, 182.8, 181.8, 2/182.1–182.3, 181, 181.2, 181.4, 181.6
See application file for complete search history.

(56) References Cited

U.S. PATENT DOCUMENTS

RE927 E * 3/1860 Mannus ..... 2/182.7
30,900 A 12/1860 Warburton
88,116 A 3/1869 Beatty
RE3,855 E * 3/1870 Beatty ..... 2/173.5
171,103 A 12/1875 Dillaway
174,998 A 3/1876 Abbott
314,048 A 3/1885 Nascimento
707,784 A * 8/1902 Johnson ..... A42C 5/04 2/182.3

(Continued)

FOREIGN PATENT DOCUMENTS

FR 372937 A * 4/1907
FR 789847 A 11/1935

(Continued)

OTHER PUBLICATIONS

Restriction Requirement dated May 16, 2025 for corresponding U.S. Appl. No. 19/182,763, filed Apr. 18, 2025.

(Continued)

*Primary Examiner* — Amy Vanatta

(74) *Attorney, Agent, or Firm* — Westman, Champlin & Koehler, P.A.; Brian D. Kaul

(57) ABSTRACT

A vented hat sweatband includes a venting layer and a sweatband layer. The venting layer includes an exterior surface, an interior surface that is opposite the exterior surface, a rigid or semi-rigid venting structure and a central opening. The venting structure includes a plurality of airflow pathways extending between the interior and exterior surfaces along a vertical axis from a top side to a bottom side that is opposite the top side. The central opening extends from the exterior surface to the interior surface, through the rigid or semi-rigid venting structure and across the plurality of airflow pathways. The sweatband layer is attached to and covers the interior surface of the venting layer.

18 Claims, 6 Drawing Sheets

(56) References Cited

U.S. PATENT DOCUMENTS

| | | | | | |
|---|---|---|---|---|---|
| 749,228 | A | * | 1/1904 | Runyan | A42C 5/04 2/182.7 |
| 960,251 | A | * | 6/1910 | Beenken | A42C 5/04 2/181.6 |
| 1,115,143 | A | * | 10/1914 | Wood | A42C 5/02 2/182.8 |
| 1,170,052 | A | * | 2/1916 | Diener | A42C 5/04 2/181.6 |
| 1,342,924 | A | | 6/1920 | Powers | |
| 1,748,792 | A | | 2/1930 | Popper | |
| 1,990,061 | A | * | 2/1935 | Bitter | A42C 5/04 2/209.5 |
| 2,129,798 | A | * | 9/1938 | Trumbull | A42C 5/04 2/182.7 |
| 2,398,363 | A | | 4/1946 | Donson | |
| 6,199,214 | B1 | | 3/2001 | Campbell | |
| 9,119,432 | B2 | | 9/2015 | Fleischmann | |
| 2009/0241240 | A1 | | 10/2009 | Han | |
| 2022/0007776 | A1 | | 1/2022 | Andersson | |

FOREIGN PATENT DOCUMENTS

| | | | | | |
|---|---|---|---|---|---|
| GB | 191203571 | A | * | 7/1912 | A42B 3/28 |
| GB | 191315009 | A | * | 6/1914 | A42C 5/04 |
| GB | 191514035 | A | * | 9/1916 | A42C 5/02 |
| GB | 2426428 | A | * | 11/2006 | A42C 5/04 |
| GB | 2480327 | A | | 11/2011 | |
| KR | 200204235 | Y1 | * | 11/2000 | A42B 1/004 |
| KR | 200418512 | Y1 | | 6/2006 | |
| KR | 20230001842 | U | | 9/2023 | |
| WO | 0076334 | A1 | | 12/2000 | |

OTHER PUBLICATIONS

Office Action dated Jun. 13, 2025 for corresponding U.S. Appl. No. 19/182,763, filed Apr. 18, 2025.

* cited by examiner

VENTED HAT SWEATBAND

CROSS REFERENCE TO RELATED APPLICATION

The present application a Continuation of U.S. application Ser. No. 19/182,763, filed Apr. 18, 2025, and is based on and claims the benefit of U.S. provisional patent application Ser. No. 63/641,649, filed May 2, 2024, the contents of which are hereby incorporated by reference their entireties.

FIELD

Embodiments of the present disclosure relate to a vented hat sweatband for use with a hat and, more specifically, to a vented hat sweatband that facilitates cooling airflows between the hat and head of a user wearing the hat.

BACKGROUND

Hats or caps generally comprise a crown that fits over a user's head and may include a brim that extends from the crown to assist in blocking the sun. The temperature within the interior of the crown can reach levels that cause the user to perspire. Many hats, such as baseball hats, biking hats, cowboy hats, etc., include a sweatband that extends around the bottom edge of the crown and lies between the user's head and the crown when worn. The sweatband may assist in absorbing the user's sweat and/or preventing the user's sweat from flowing down their face and/or into his or her eyes through a snug fit between the sweatband and the user's head.

The tight seal formed between the sweatband and the user's head restricts air from entering the interior of the crown and inhibits the cooling of the interior. This exacerbates the high temperature issue, particularly when wearing the hat on hot days or while performing vigorous activities, and contributes to higher sweat generation and significant discomfort for the user. Additionally, due to the conventional hat sweatband being attached directly to the crown, sweat frequently travels from the sweatband to the crown resulting in unsightly sweat stains on the crown.

SUMMARY

Embodiments of the present disclosure generally relate to vented hat sweatbands, hats that include the vented hat sweatband, and methods of forming hats having the vented hat sweatband. One embodiment of the vented hat sweatband includes a venting layer and a sweatband layer. The venting layer includes an exterior surface, an interior surface that is opposite the exterior surface, a rigid or semi-rigid venting structure and a central opening. The venting structure includes a plurality of airflow pathways extending between the interior and exterior surfaces along a vertical axis from a top side to a bottom side that is opposite the top side. The sweatband layer is attached to and covers the interior surface of the venting layer. The central opening extends from the exterior surface to the interior surface, through the rigid or semi-rigid venting structure and across the plurality of airflow pathways.

One embodiment of the hat includes a crown and a vented hat sweatband. The crown includes a top side, a bottom side that is opposite the top side, and a bottom edge at the bottom side surrounding an opening to an interior cavity that is configured to receive a top portion of a user's head. The vented hat sweatband is attached along the bottom edge of the crown and includes a venting layer. The venting layer includes an exterior surface that faces the crown, an interior surface that is opposite the exterior surface and faces the interior cavity, a rigid or semi-rigid venting structure and a central opening. The venting structure includes a plurality of airflow pathways extending between the interior and exterior surfaces along a vertical axis from a top side to a bottom side that is opposite the top side, wherein an airflow may travel through each of the airflow pathways. The central opening extends from the exterior surface to the interior surface, through the rigid or semi-rigid venting structure and across the plurality of airflow pathways.

In one embodiment of a method of forming a hat having a vented hat sweatband, a crown of a hat and a first sweatband layer are provided. The crown includes a top side, a bottom side that is opposite the top side, and a bottom edge at the bottom side surrounding an opening to an interior cavity that is configured to receive a top portion of a user's head. The vented hat sweatband is attached along the bottom edge of the crown. The vented hat sweatband includes a venting layer including an exterior surface that faces the crown, an interior surface that is opposite the exterior surface and faces the interior cavity, a rigid or semi-rigid venting structure and a central opening. The rigid or semi-rigid venting structure defines a plurality of airflow pathways extending between the interior and exterior surfaces along a vertical axis from a top side to a bottom side that is opposite the top side. The central opening extends from the exterior surface to the interior surface, through the rigid or semi-rigid venting structure and across the plurality of airflow pathways. The first sweatband layer covers the interior surface of the venting layer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
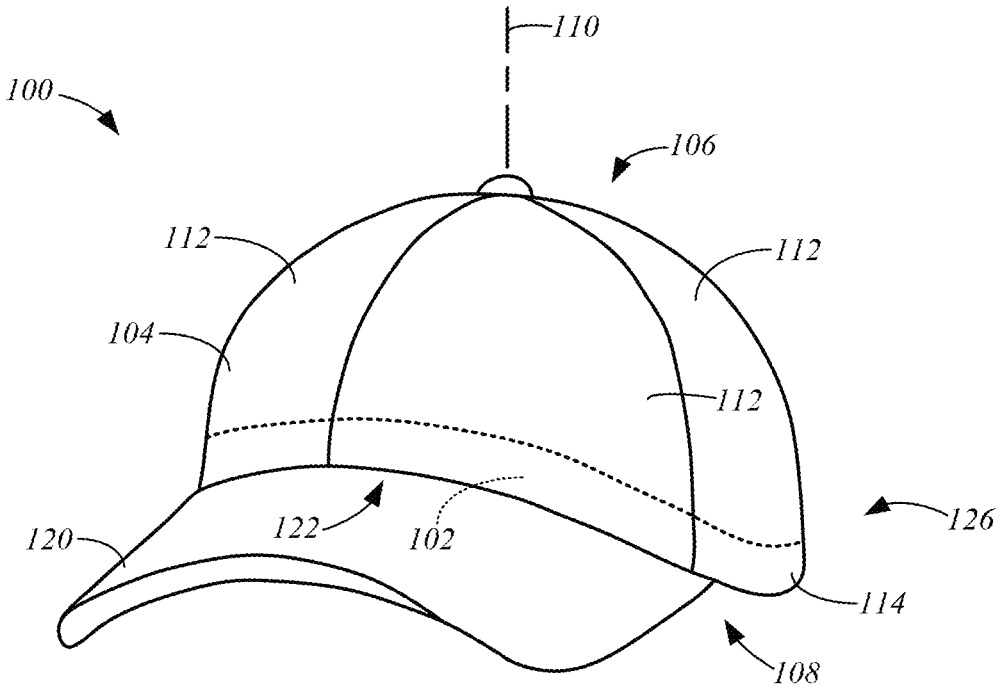
FIGS. 1 and 2 respectively are isometric view and bottom views of an example hat 100 having vented hat sweatband 102, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 2:
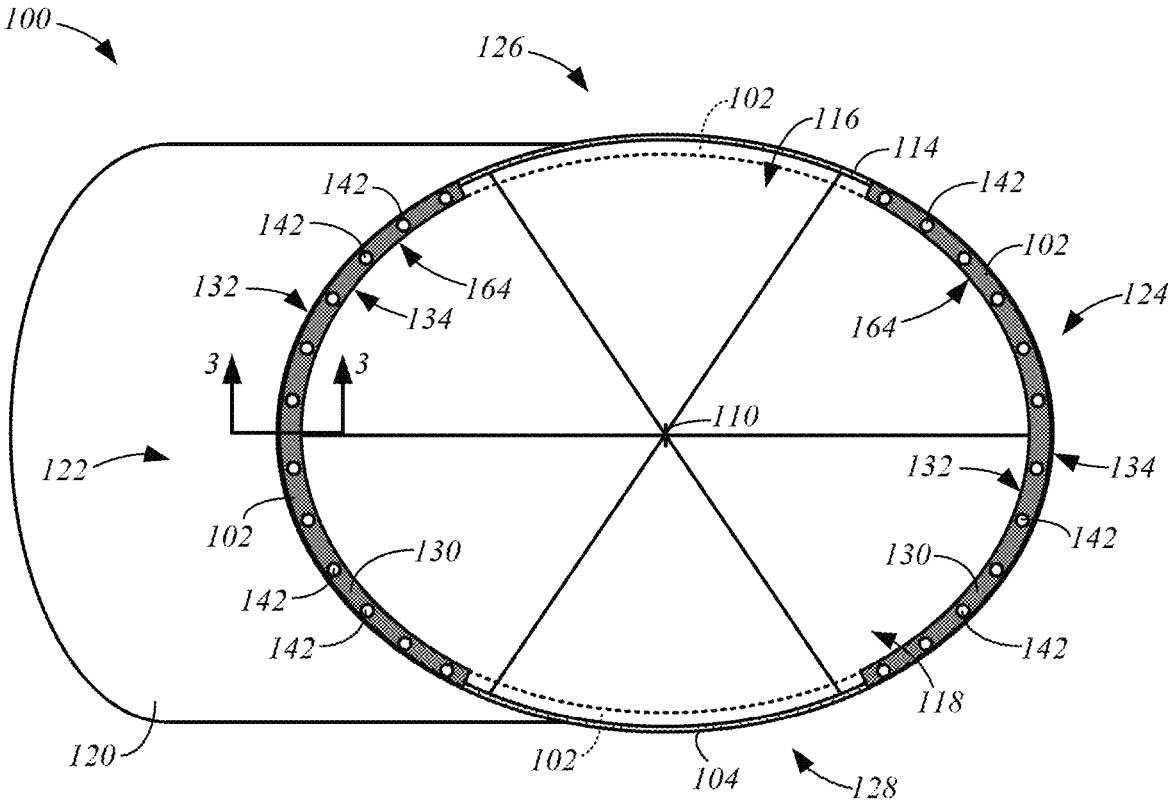
Figure 3:
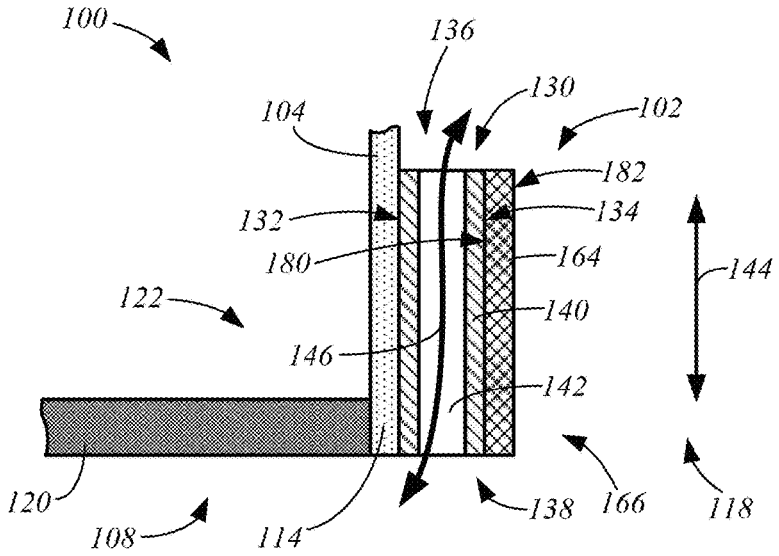
FIG. 3 is a simplified cross-sectional view of the hat of FIG. 2, taken generally along line 3-3, in accordance with embodiments of the present disclosure.
Figure 4:
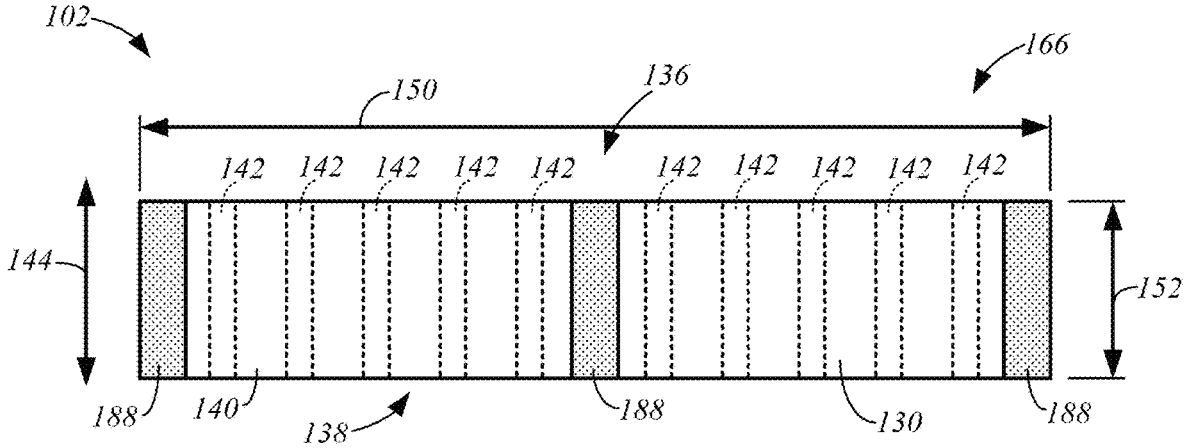
FIG. 4 is a simplified side view of an example vented hat sweatband, in accordance with embodiments of the present disclosure.

Embodiments of the present disclosure generally relate to vented hat sweatbands, hats that include the vented hat sweatband, and methods of forming hats having the vented hat sweatband. FIGS. 1 and 2 respectively are isometric view and bottom views of an example hat 100 having at least one vented hat sweatband 102, in accordance with embodiments of the present disclosure. FIG. 3 is a simplified cross-sectional view of the hat 100 of FIG. 2, taken generally along line 3-3, in accordance with embodiments of the present disclosure. FIG. 4 is a simplified side view of an example vented hat sweatband 102, in accordance with embodiments of the present disclosure.

While the example hat 100 is in the form of a baseball hat or cap, it is understood that embodiments of the present disclosure apply to many different types of hats, such as cowboy hats, bucket hats, berets, fedoras, and other hats.

In one example, the hat 100 includes a crown 104 having a top side 106, a bottom side 108 that is opposite the top side 106 and is displaced from the top side 106 along a central axis 110. The crown 104 may be comprised of multiple panels 112 that are sewn together. The crown 104 includes a bottom edge 114 at the bottom side 108 that surrounds an opening 116 to an interior cavity 118. It is understood that, when the hat 100 is worn by a user, the interior cavity 118 receives a top portion of the user's head.

Since the example hat of FIGS. 1 and 2 is in the form of a baseball hat, it includes a brim, bill or visor 120 that generally extends in a radial direction from the axis 110 from a front side 122 of the bottom edge 114 of the crown 104. The hat 100 may be fitted or have an adjustable bottom edge circumference using a conventional size adjusting mechanism at a back side 124 of the hat 100, for example.

The hat 100 includes one or more of the vented hat sweatbands 102 that are attached either directly or indirectly to the crown 104, such as a vented hat sweatband 102 located at the front side 122, a vented hat sweatband 102 located at the back side 124, as shown in FIG. 2. Likewise, vented hat sweatbands 102 may be located at one or both sides 126 and 128 of the hat 100 extending between the front side 122 and the back sides 124, as indicated in phantom lines in FIG. 2. The vented hat sweatband or sweatbands 102 are attached along the bottom edge 114 of the crown 104, which means that the sweatbands 102 are connected in some manner (directly or indirectly) to the crown 104 such that they are supported along the bottom edge 114, such as near or adjacent to the bottom edge 114. In one embodiment, the hat 100 includes a single vented hat sweatband that extends along the entire bottom edge 114 of the crown 104 and surrounds the central axis 110.

In one embodiment, each vented hat sweatband 102 includes a venting layer 130 having an exterior surface 132 that faces in the crown 104, and an interior surface 134 that is opposite the exterior surface 132 and faces the interior cavity 118 or toward the central axis 110, as shown in FIGS. 2 and 3. As discussed below, the exterior surface 132 and the interior surface 134 may be covered using components of the hat 100, such as the crown 104, a sweatband that is attached to the crown 104, etc. The venting layer 130 also includes a top side 136 and a bottom side 138 that is opposite the top side 136, as shown in FIGS. 3 and 4. The top and bottom sides 136, 138 extend between the exterior surface 132 and the interior surface 134.

The venting layer 130 includes a rigid or semi-rigid venting structure 140 that extends between or includes the interior surface 134 and the exterior surface 132 and includes or defines a plurality of airflow pathways 142 that extend along a vertical axis 144, which generally extends along the central axis 110, between the top side 136 and the bottom side 138. An airflow 146 may travel through each of the airflow pathways 142 between the top and bottom sides 136, 138, such as into or out of the interior cavity 118, for example.

The vented hat sweatband 102 may have an elongated shape having a length 150 of approximately 4.0-10.0 inches, such as about 8.0 inches, and a height 152 measured between the top and bottom sides 136, 138 of approximately 0.5-1.5 inches, such as about 1.0 inch, as shown in FIG. 4. A thickness of the venting layer 130 measured from the interior surface 134 to the exterior surface 132 may be approximately 0.2-0.3 inches, such as about 0.25 inches, for example.

The rigid or semi-rigid venting structure 140 maintains the open airflow pathways 142 during normal use of wearing and handling the hat 100. Thus, the rigid or semi-rigid venting structure 140 may be somewhat flexible while still preventing the airflow pathways 142 from collapsing during normal use of the hat 100. The venting structure 140 may be formed of any suitable material such as, for example, plastic, polyurethane (e.g., polyurethane foam), neoprene, polyolefin, polypropylene (e.g., foam or plastic), foam rubber, or another suitable material.

Figure 5:
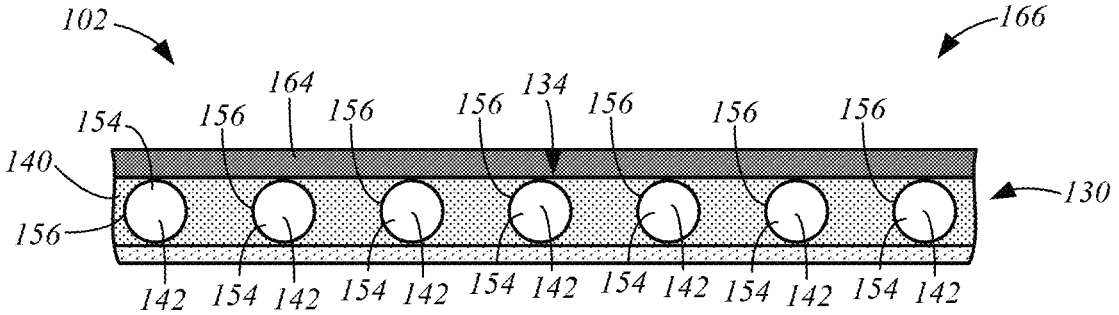
FIGS. 5 and 6 are simplified cross-sectional views of the vented hat sweatband, in accordance with embodiments of the present disclosure.
Figure 6:
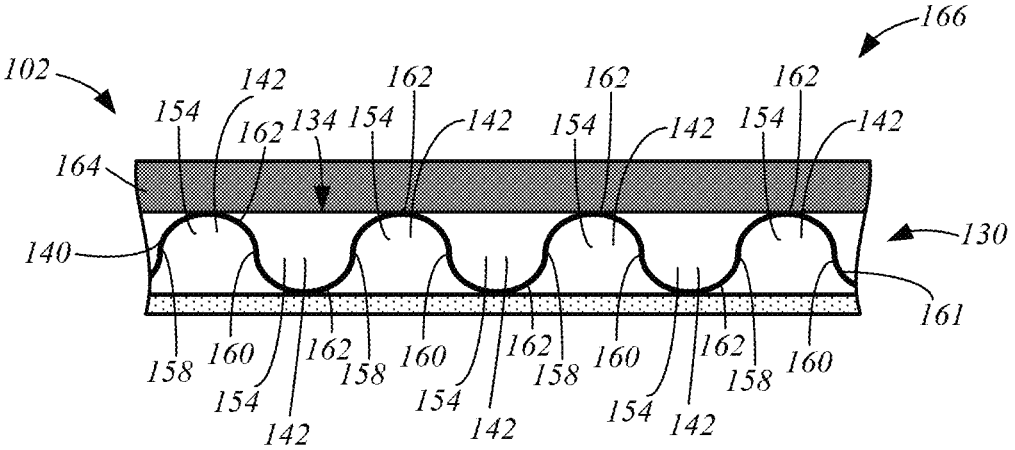

FIGS. 5 and 6 are simplified cross-sectional views of an example vented hat sweatband 102, in accordance with embodiments of the present disclosure. In some embodiments, the venting structure 140 includes or defines a plurality of channels or ducts 154 through which each airflow pathway 142 extends. In one embodiment, each of the channels 154 includes a tubular structure or sidewall 156 that is supported between the interior and exterior surfaces 134, 132, as shown in FIG. 5. In another embodiment, each of the channels 154 includes a pair of side walls 158 and 160 that extend between the interior and exterior surfaces 134, 132, as shown in FIG. 6. Here, the venting structure 140 may comprise a section of corrugated material 161 having a plurality of substantially parallel folds 162 that define the sidewalls 158 and 160, such as shown in FIG. 6.

In some embodiments, the vented hat sweatband 102 includes a sweatband layer 164 that covers the interior surface 134 of the venting layer 130 or the venting structure 140, as shown in FIGS. 3, 5 and 6. The sweatband layer 164 generally performs conventional sweatband functions and may comprise conventional materials used in sweatbands or hat sweatbands, such as moisture wicking materials, moisture absorbing materials, and/or other conventional sweatband materials. Examples of suitable materials that may be used to form the sweatband layer 164 include cotton, nylon, polyester and/or microfiber.

In some embodiments, the exterior surface 132 of the venting layer 130 is attached to the interior surface of the crown 104, as shown in FIG. 3, such as using an adhesive, by sewing, or another suitable technique. In some embodiments, the venting structure 140 includes the exterior surface 132.

In some embodiments, the vented hat sweatband 102 is in the form of an assembly 166 that comprises the venting layer 130 and the sweatband layer 164, which is attached to the interior surface 134 of the venting structure 140, such as using an adhesive or another suitable technique. The assembly 166 may be permanently or removably attached to the crown 104 to form the hat 100. In one example, the assembly 166 includes one or more fasteners 188 (FIG. 4) on the exterior surface 132 and/or the interior surface 134, such as a hook and loop fasteners or other suitable fasteners, that facilitate removably attaching the vented hat sweatband 102 to the crown 104. This allows a user to periodically remove the vented hat sweatband 102 (e.g., assembly 166) for cleaning and reuse, or disposal and replacement, for example.

When the configuration of the hat 100 shown in FIG. 3 is worn by a user, the sweatband layer 164 generally forms a snug fit to the top portion of the user's head including the user's forehead. Thus, the interface between the sweatband layer 164 and the user should feel similarly to when a conventional hat having an integrated sweatband, such as a conventional baseball hat, is worn.

In addition to the benefit of providing airflows 146 into and out of the interior 118 of the crown 104 that lower the temperature of the interior 118 and facilitate cooling and drying of the portion of the user's head covered by the crown 104, the displacement of the sweatband layer 164 from the crown 104 (see, e.g., FIG. 3) also impedes the transfer of sweat from the sweatband layer 164 to the crown 104. As a result, the configuration of the hat 100 shown in FIG. 3 reduces or avoids the development of unsightly sweat stains in the crown 104 relative to conventional hats, in which a sweatband is directly attached to the crown 104 or comes into contact with the crown 104 when worn by a user.

Figure 7:
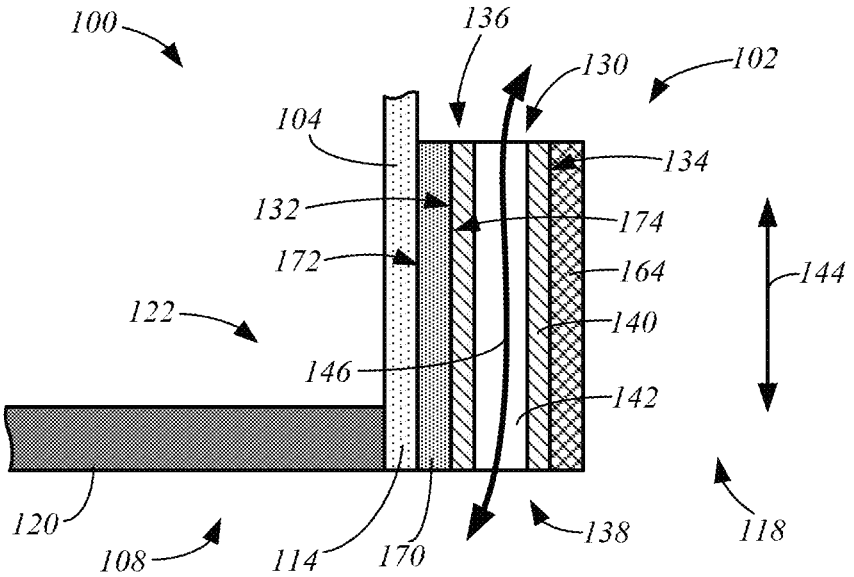
FIGS. 7 and 8 are simplified cross-sectional views, which are generally similar to the view of FIG. 3, of an example hat that includes a vented hat sweatband, in accordance with embodiments of the present disclosure.

In some embodiments, the vented hat sweatband 102 is combined with a conventional hat that includes a sweatband layer. FIG. 7 is a simplified cross-sectional view, which is generally similar to the view of FIG. 3, of an example hat 100 that includes a vented hat sweatband 102, in accordance with embodiments of the present disclosure. In one embodiment, a sweatband layer 170 is attached to the crown 104 along the bottom edge 114. An exterior surface 172 of the sweatband layer 170 faces the crown 104 and an interior surface 174 of the sweatband layer 170 faces the interior cavity 118. Thus, the combination of the crown 104 and the sweatband layer 170 generally form a conventional hat, such as a conventional baseball hat.

In one embodiment, the exterior surface 132 of the venting layer 130 is attached to the interior surface 174 of the sweatband layer 170 and the sweatband layer 164 is attached to the interior surface 134 of the venting layer 130, as shown in FIGS. 3 and 7. The hat 100 of FIG. 7 provides similar benefits to the hat of FIG. 3. The venting layer 130 and the attached sweatband 164 generally form the vented hat sweatband 102 or the assembly 166 and may either be permanently or removably attached to the sweatband layer 170, such as using the fasteners 188 (FIG. 4).

Figure 8:
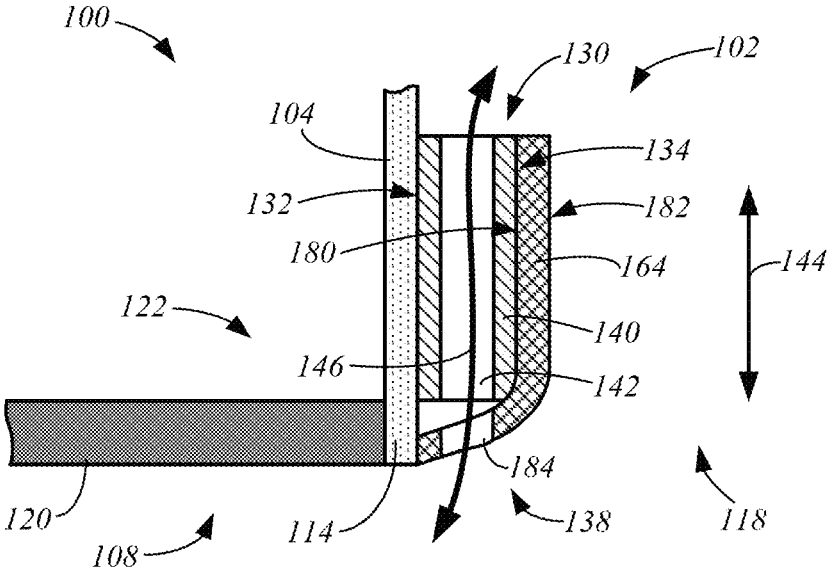

FIG. 8 is a simplified side cross-sectional view, which is similar to FIG. 7, of another example hat 100 that includes the vented hat sweatband 102, in accordance with embodiments of the present disclosure. In one embodiment, similar to the hat shown in FIG. 7, the sweatband layer 164 is attached to the crown 104 along the bottom edge 114. An exterior surface 180 of the sweatband layer 164 faces the crown 104 and an interior surface 182 of the sweatband layer 164 faces the interior cavity 118 to generally form a conventional hat structure. In one embodiment, the venting layer 130 is positioned between the sweatband layer 164 and the crown 104. The exterior surface 132 of the venting layer 130 may be attached to the crown 104 and/or the interior surface 134 of the venting layer 130 may be attached to the exterior surface 180 of the sweatband layer 164, as shown in FIG. 8.

In one embodiment, the sweatband layer 164 includes at least one opening 184 to the airflow pathways 142 of the venting layer 130, as shown in FIG. 8. This allows an airflow 146 to travel through the at least one opening 184 in the sweatband layer 164 and through the airflow pathways 142 of the venting layer 130. The at least one opening 184 may include a plurality of openings, in which each of the openings provides an airflow path through the sweatband layer 164 and to one or more of the airflow pathways 142.

Figure 9:
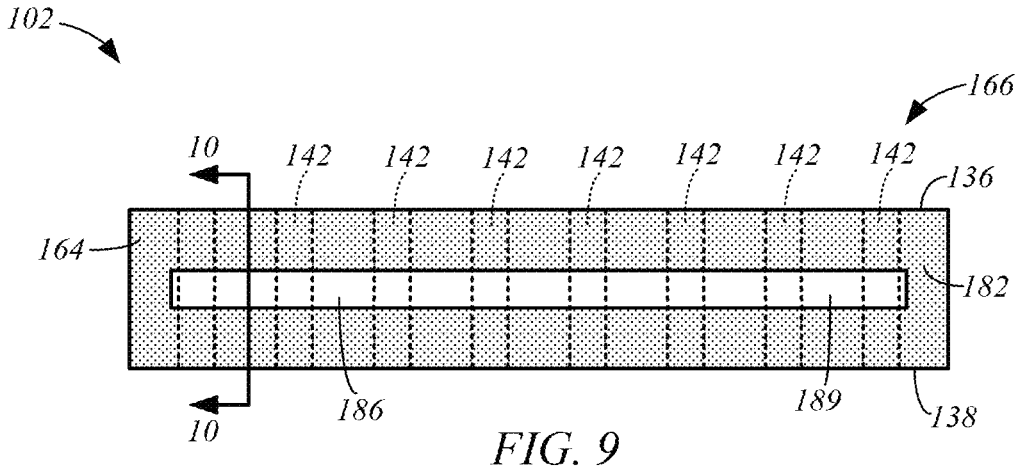
FIGS. 9 and 10 respectively show a front view of an example vented hat sweatband and a side cross-sectional view of the vented hat sweatband of FIG. 9 taken generally along line 10-10, in accordance with embodiments of the present disclosure.
Figure 10:
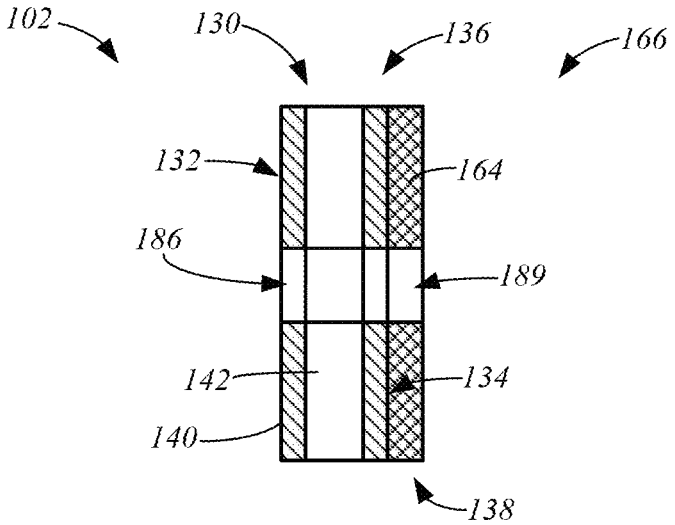

FIGS. 9 and 10 respectively show a front view of an example vented hat sweatband 102 and a side cross-sectional view of the vented hat sweatband 102 of FIG. 9 taken generally along line 10-10, in accordance with embodiments of the present disclosure. According to this embodiment, the venting layer 130 includes an opening 186 that extends from the exterior surface 132 through the structure 140 to the interior surface 134 within a central region of the venting layer 130, as shown in FIG. 10. In one embodiment, the sweatband layer 164, which covers and may be attached to the interior surface 134, includes a corresponding opening 189 that overlays the opening 186 of the venting layer 130. The openings 186 and 189 allow for airflows traveling through the airflow pathways 142 to reach the portion of the user's head that is covered by the vented hat sweatband 102.

Some embodiments of the present disclosure are directed to embodiments of the vented hat sweatband 102 described above that may be attached (e.g., permanently or removably) to an existing hat, such as to the crown and/or a sweatband layer of an existing hat, to form one or more of the embodiments of the hat 100 described above.

Thus, in some embodiments, the vented hat sweatband 102 includes the venting layer 130 and a sweatband layer 164, such as shown in FIG. 3. The venting layer 130 and the sweatband layer 164 may each be formed in accordance with one or more of the embodiments described above.

In one embodiment, the venting layer 130 includes an exterior surface 132 and an opposing interior surface 134, and a rigid or semi-rigid venting structure 140 defining a plurality of airflow pathways 142 extending between the interior and exterior surfaces 134, 132 along a vertical axis 144 from a top side 136 to a bottom side 138 that is opposite the top side 136, as shown in FIGS. 3 and 4. In one embodiment, the sweatband layer 164 is attached to and covers at least a portion of the interior surface 134 of the venting layer 130.

Figure 11:
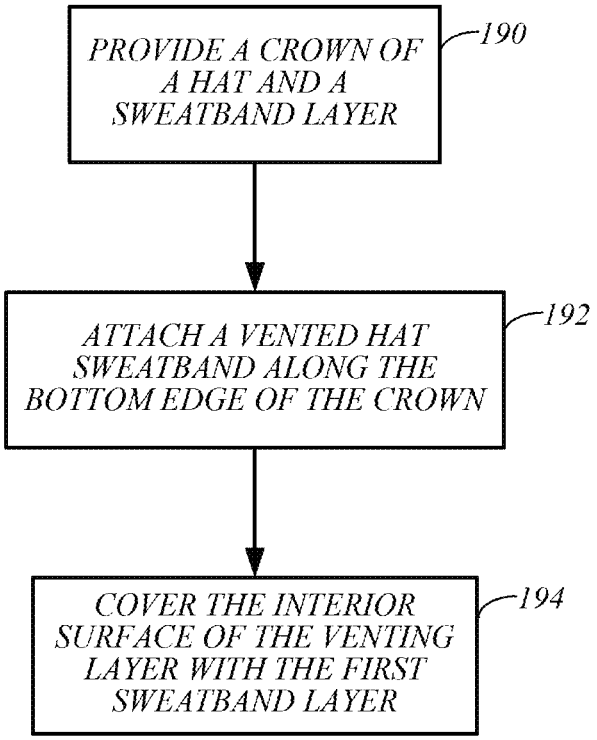
FIG. 11 is a flowchart illustrating a method of forming a hat having a vented hat sweatband, in accordance with embodiments of the present disclosure.

Additional embodiments are directed to a method of forming a hat 100 having a vented hat sweatband 102, such as the embodiments of the hat 100 described above. FIG. 11 is a flowchart illustrating an example of the method, in accordance with embodiments of the present disclosure.

At 190 of the method, a crown 104 of a hat and a sweatband layer 164 are provided. The crown may include a top side 106, a bottom side 108 that is opposite the top side 106, and a bottom edge 114 at the bottom side 108 surrounding an opening 116 to an interior cavity 118 that is configured to receive a top portion of a user's head, as discussed above and shown in FIGS. 1 and 2. The sweatband layer 164 may be formed in accordance with one or more embodiments described above.

At 192 of the method, a vented hat sweatband 102 is attached along (e.g., near or adjacent to) the bottom edge 114 of the crown 104, such as discussed above. In one embodiment, the vented hat sweatband 102 includes a venting layer 130 comprising an exterior surface 132 that faces the crown 104, an interior surface 134 that is opposite the exterior surface 132 and faces the interior cavity 118, and a rigid or semi-rigid venting structure 140, such as shown in FIGS. 2 and 3. The venting structure 140 includes a plurality of airflow pathways 142 that extend between the interior and exterior surfaces 134, 132 along a vertical axis 144 from a top side 136 to a bottom side 138 that is opposite the top side 136, such as discussed above and shown in FIGS. 3 and 4.

At 194 of the method, the interior surface 134 of the venting layer 130 is covered (e.g., partially or completely) by the sweatband layer 164, such as shown in FIGS. 2, 3, 7 and 8. Step 194 may be performed either prior to or after step 192.

In some embodiments, the method forms the hat 100 shown in FIG. 3 or FIG. 7, in which the sweatband layer 164 is attached to the interior surface 134 of the venting layer 130 and may be considered as a component of the vented hat sweatband 102 or the assembly 166. In one embodiment, the vented hat sweatband 102 is attached in step 192 by attaching the exterior surface 132 of the venting layer 130 to the crown 104 to form the hat 100 of FIG. 3, or by attaching the exterior surface 132 of the venting layer 130 to a sweatband layer 170 that is attached to the crown 104 to form the hat 100 of FIG. 7.

In some embodiments, the method forms the hat 100 shown in FIG. 8. Here, the sweatband layer 164 is attached along the bottom edge 114 of the crown 104 and includes an interior surface 134 that faces the interior cavity 118, and an exterior surface 132 that faces the crown 104. Thus, the sweatband layer 164 may be a component of an existing (e.g., premade) hat, for example. The vented hat sweatband 102 is attached in step 192 by attaching the venting layer 130 between the sweatband layer 164 and the crown 104, such that the exterior surface 132 of the venting layer 130 faces the crown 104 and the interior surface 134 of the venting layer 130 faces the interior surface 180 of the sweatband layer 164. In some embodiments of the method, at least one opening 184 is formed in the sweatband layer 164 that corresponds to one or more of the airflow pathways 142, as discussed above.

Although the embodiments of the present disclosure have been described with reference to preferred embodiments, workers skilled in the art will recognize that changes may be made in form and detail without departing from the spirit and scope of the present disclosure.

It will be understood that when an element is referred to as being "connected," "coupled," or "attached" to another element, it can be directly connected, coupled or attached to the other element, or it can be indirectly connected, coupled, or attached to the other element where intervening or intermediate elements may be present. In contrast, if an element is referred to as being "directly connected," "directly coupled" or "directly attached" to another element, there are no intervening elements present. Drawings illustrating direct connections, couplings or attachments between elements also include embodiments, in which the elements are indirectly connected, coupled or attached to each other.

What is claimed is:

1. A hat comprising:

a crown having a top side, a bottom side that is opposite the top side, and a bottom edge at the bottom side surrounding an opening to an interior cavity that is configured to receive a top portion of a user's head; and a vented hat sweatband attached along the bottom edge of the crown and including a venting layer comprising:

an exterior surface that faces the crown;

an interior surface that is opposite the exterior surface and faces the interior cavity;

a rigid or semi-rigid venting structure defining a plurality of airflow pathways extending between the interior and exterior surfaces along a vertical axis from a top side to a bottom side that is opposite the top side, wherein an airflow may travel through each of the airflow pathways; and a central opening extending from the exterior surface to the interior surface, through the rigid or semi-rigid venting structure and across the plurality of airflow pathways.

2. The hat according to claim 1, wherein:

the venting structure includes a plurality of channels each comprising a pair of side walls or a tubular structure; and each airflow pathway extends through one of the channels.

3. The hat according to claim 2, wherein the venting structure comprises a section of corrugated material including a plurality of substantially parallel folds of the material that define the sidewalls.

4. The hat according to claim 1, including a first sweatband layer that covers the interior surface of the venting layer.

5. The hat according to claim 4, wherein the vented hat sweatband comprises an assembly of the venting layer and the first sweatband layer, which is attached to the interior surface of the venting layer.

6. The hat according to claim 5, wherein the vented hat sweatband includes a fastener that removably attaches the vented hat sweatband to the crown.

7. The hat according to claim 5, wherein the first sweatband layer comprises at least one material selected from the group consisting of cotton, nylon, polyester and microfiber, and the venting layer comprises at least one material selected from the group consisting of plastic, polyurethane, neoprene, polyolefin, polypropylene and foam rubber.

8. The hat according to claim 4, wherein:

the hat includes a second sweatband layer that is attached to the crown along the bottom edge and includes an interior surface that faces the interior cavity;

the exterior surface of the venting layer is attached to the interior surface of the second sweatband layer; and the first sweatband layer is attached to the interior surface of the venting layer.

9. The hat according to claim 4, wherein:

the first sweatband layer is attached to the crown along the bottom edge and includes an interior surface that faces the interior cavity and an exterior surface that faces the crown; and the venting layer is positioned between the first sweatband layer and the crown.

10. The hat according to claim 9, wherein the first sweatband layer includes at least one opening to the airflow pathways, wherein an airflow may travel through the at least one opening in the first sweatband layer and through the airflow pathways.

11. A vented hat sweatband for attachment to a crown of a hat comprising:

a venting layer including:

an exterior surface;

an interior surface that is opposite the exterior surface;

a rigid or semi-rigid venting structure defining a plurality of airflow pathways extending between the interior and exterior surfaces along a vertical axis from a top side to a bottom side that is opposite the top side; and a central opening extending from the exterior surface to the interior surface, through the rigid or semi-rigid venting structure and across the plurality of airflow pathways; and a sweatband layer attached to and covering the interior surface of the venting layer.

12. The vented hat sweatband according to claim 11, wherein:

the venting structure includes a plurality of channels each comprising a pair of side walls or a tubular structure; and each airflow pathway extends through one of the channels.

13. The vented hat sweatband according to claim 12, wherein the venting structure comprises a section of corrugated material including a plurality of substantially parallel folds of the material that define the sidewalls.

14. The vented hat sweatband according to claim 11, wherein the vented hat sweatband includes a fastener configured to removably attach the vented hat sweatband to a crown of a hat.

15. The vented hat sweatband according to claim 11, wherein the first sweatband layer comprises at least one material selected from the group consisting of cotton, nylon, polyester and microfiber, and the venting layer comprises at least one material selected from the group consisting of plastic, polyurethane, neoprene, polyolefin, polypropylene and foam rubber.

16. A method of forming a hat having a vented hat sweatband comprising:

providing a crown of a hat having a top side, a bottom side that is opposite the top side, and a bottom edge at the bottom side surrounding an opening to an interior cavity that is configured to receive a top portion of a user's head;

providing a first sweatband layer; and attaching a vented hat sweatband along the bottom edge of the crown, the vented hat sweatband comprising a venting layer including:

an exterior surface that faces the crown;

an interior surface that is opposite the exterior surface and faces the interior cavity;

a rigid or semi-rigid venting structure defining a plurality of airflow pathways extending between the interior and exterior surfaces along a vertical axis from a top side to a bottom side that is opposite the top side; and a central opening extending from the exterior surface to the interior surface, through the rigid or semi-rigid venting structure and across the plurality of airflow pathways, wherein the first sweatband layer covers the interior surface of the venting layer.

17. The method according to claim 16, wherein:

the first sweatband layer is attached to the interior surface of the venting layer; and attaching the vented hat sweatband comprises attaching the exterior surface of the venting layer to the crown or to a second sweatband layer that is attached to the crown.

18. The method according to claim 16, wherein:

the first sweatband layer is attached along the bottom edge of the crown and includes an interior surface that faces the interior cavity and an exterior surface that faces the crown; and attaching the vented hat sweatband comprises attaching the venting layer between the first sweatband layer and the crown, wherein the exterior surface of the venting layer faces the crown and the interior surface of the venting layer faces the exterior surface of the first sweatband layer.

* * * * *